US010247512B1

(12) United States Patent
Leslie

(10) Patent No.: US 10,247,512 B1
(45) Date of Patent: Apr. 2, 2019

(54) SPLIT STOCK ASSEMBLY

(71) Applicant: Jimi Leslie, San Diego, CA (US)

(72) Inventor: Jimi Leslie, San Diego, CA (US)

( * ) Notice: Subject to any disclaimer, the term of this patent is extended or adjusted under 35 U.S.C. 154(b) by 0 days.

(21) Appl. No.: 16/011,995

(22) Filed: Jun. 19, 2018

(51) Int. Cl.
*F41C 23/12* (2006.01)
*F41C 23/20* (2006.01)

(52) U.S. Cl.
CPC ..... *F41C 23/12* (2013.01); *F41C 23/20* (2013.01)

(58) Field of Classification Search
CPC ..... F41C 23/12; F41C 23/14; F41C 23/20; F41A 11/00; F41A 11/02; F41A 11/04
See application file for complete search history.

(56) References Cited

U.S. PATENT DOCUMENTS 22,626 A * 1/1859 Colt ..... F41C 23/04 42/72
28,433 A * 5/1860 Alsop ..... F41C 23/04 42/72
32,003 A * 4/1861 Savage ..... F41C 23/04 42/72
179,075 A * 6/1876 Smith ..... F41C 23/14 42/73
190,033 A * 4/1877 Hartley ..... F41C 23/14 42/73
287,741 A * 10/1883 Vickers, Jr. ..... F41C 23/04 42/72
305,537 A * 9/1884 Schwatka ..... F41C 23/04 42/72
570,145 A * 10/1896 Pittavino ..... F41C 23/04 42/72
724,327 A * 3/1903 Phillips ..... F41C 23/04 42/72
762,862 A * 6/1904 Phillips ..... F41C 23/12 224/577
931,328 A * 8/1909 Marble ..... F41C 23/04 42/72
1,063,061 A * 5/1913 Pickering ..... F41C 23/14 42/73
1,869,086 A * 7/1932 Ash ..... F41C 23/14 42/73
2,387,691 A * 10/1945 Sunderland ..... F41A 3/12 42/69.03
3,267,923 A * 8/1966 Ronci ..... F41C 23/10 124/84
5,924,233 A * 7/1999 Strobel ..... F41C 23/12 42/72

(Continued)

*Primary Examiner* — Benjamin P Lee
(74) *Attorney, Agent, or Firm* — Kevin Keener; Keener and Associates P.C.

(57) ABSTRACT

A split stock assembly for a firearm and method of use is disclosed. The firearm has an action and a grip attached to the action. The grip is removably secured to a stock. The grip has a recess disposed on a back portion of the grip. The stock has a protrusion disposed on a front portion of the stock. A user may place the protrusion of the stock within the recess of the grip to transition the handle of the firearm from a pistol style grip to a rifle style stock. The protrusion and recess may be dovetail shaped to allow them to lock together and prevent the stock from being removed from the grip. The firearm may utilize pin assemblies to prevent unwanted removal of the stock from the grip. The pin assemblies are disposed in channels in the grip and the protrusion of the stock.

9 Claims, 16 Drawing Sheets

(56) References Cited

U.S. PATENT DOCUMENTS

| | | | | |
|---|---|---|---|---|
| 6,662,485 | B2 * | 12/2003 | Kay | F41C 23/16<br>42/75.03 |
| 7,162,823 | B2 * | 1/2007 | Schoppman | F41A 11/04<br>42/75.01 |
| 9,664,478 | B2 * | 5/2017 | Robinson | F41C 23/04 |
| 2004/0211104 | A1 * | 10/2004 | Eberle | F41C 23/00<br>42/71.02 |
| 2005/0215092 | A1 * | 9/2005 | Schoppman | F41A 11/04<br>439/101 |
| 2007/0006508 | A1 * | 1/2007 | Baker | F41A 11/02<br>42/71.02 |
| 2015/0219416 | A1 * | 8/2015 | Chvala | F41C 23/04<br>42/71.01 |
| 2017/0153084 | A1 * | 6/2017 | Tarazi | F41C 23/12 |

* cited by examiner

SPLIT STOCK ASSEMBLY

FIELD OF THE INVENTION

The invention has pertains to firearms and more particularly to a split stock assembly for shortening or lengthening the stock of a firearm.

BACKGROUND OF INVENTION

Firearms are well known and come in several configurations. The two most well-known configurations are pistols and rifles. The pistol has a shaped handgrip which allows a user to hold the firearm with a single hand. The rifle is a larger configuration which is meant for two-handed operation. The rifle configuration has a stock at the rear of the firearm. The stock permits a user to brace the firearm against the user's shoulder for greater control during firing. Occasionally, a user may desire to operate a firearm which normally has a pistol grip in a manner similar to that of a rifle where there is a stock. Additionally, a user may desire to operate a firearm which is normally in a rifle configuration in a manner as that with a pistol grip without a stock. What is needed therefore is a firearm in which a user can easily manipulate the firearm to change the firearm from one with a pistol grip to on with a stock and vice versa.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a firearm comprising an action; a grip attached to said action, wherein said grip has a recess disposed on a back portion of said grip; and a stock removably secured to said grip, wherein said stock has a protrusion disposed on a front portion of said stock, wherein said protrusion is disposed within said recess. The firearm may further comprise one or more pin assemblies comprising a pin wherein said grip further comprises one or more channels disposed in said grip; and wherein each of said one or more pin assemblies is respectively disposed in said one or more channels. In another embodiment said one or more pin assemblies further comprises a set screw having a threaded exterior surface engaging an inner surface of said channel and an inner recess, wherein said pin is disposed in said inner recess of said set screw. The one or more pin assemblies may also further comprise a spring.

In another embodiment of the invention said recess of said grip is shaped as a female dovetail and said protrusion of said stock is shaped as a male dovetail. In another embodiment of the invention said grip has a front portion disposed in a direction of firing of said firearm, a rear portion disposed in a direction opposite a direction of firing said firearm, a top portion disposed near an action of said firearm, and a bottom portion disposed at an end opposite from said action of said firearm; wherein said recess of said grip has a first end and a second end, wherein said first end is disposed at said bottom portion of said grip and said second end is disposed in a top portion of said grip.

In another embodiment of the invention said grip has a front portion disposed in a direction of firing of said firearm, a rear portion disposed in a direction opposite a direction of firing said firearm, a top portion disposed near an action of said firearm, and a bottom portion disposed at an end opposite from said action of said firearm; wherein said recess of said grip has a first end and a second end, wherein said first end is disposed at said rear portion of said grip and said second end is disposed in a front portion of said grip.

The firearm may further comprise a means for securing said protrusion in said recess. The firearm may further comprise one or more bolts; wherein said grip further comprises one or more channels; wherein said one or more bolts are disposed in said one or more channels; and wherein said one or more bolts engage said protrusion of said stock. In another embodiment of the invention said protrusion further comprises one or more apertures for receiving said one or more bolts. In another embodiment of the invention said protrusion has one or more indentations for receiving an end of one or more pins.

The invention is also directed toward a method for changing the handle of a firearm. The method comprises disengaging said protrusion from said recess; removing said stock from said grip; and firing said firearm by holding said firearm solely by said grip. The method may further comprise placing said protrusion of said stock completely within said recess of said grip; ensuring said stock is secured to said grip; placing an end of said stock against a user's shoulder; and firing said firearm a second time. The method may further comprise removing a factory installed handle from said action of said firearm; and attaching said grip to said action. The method may further comprise cutting off a portion of a factory installed handle attached to said action of said firearm; and attaching said grip to a remaining portion of said factory installed handle. The method may further comprise placing one or more bolts through one or more channels disposed in said grip.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

The invention is directed toward a split stock assembly for a firearm. The split stock assembly may be retrofitted onto any firearm (i.e. pistol, rifle, shotgun, automatic, semiautomatic weapon) or may be provided as an OEM install on any firearm. The split stock assembly may be utilized on any firearm type, such as a rifle or shotgun.

Figure 1:
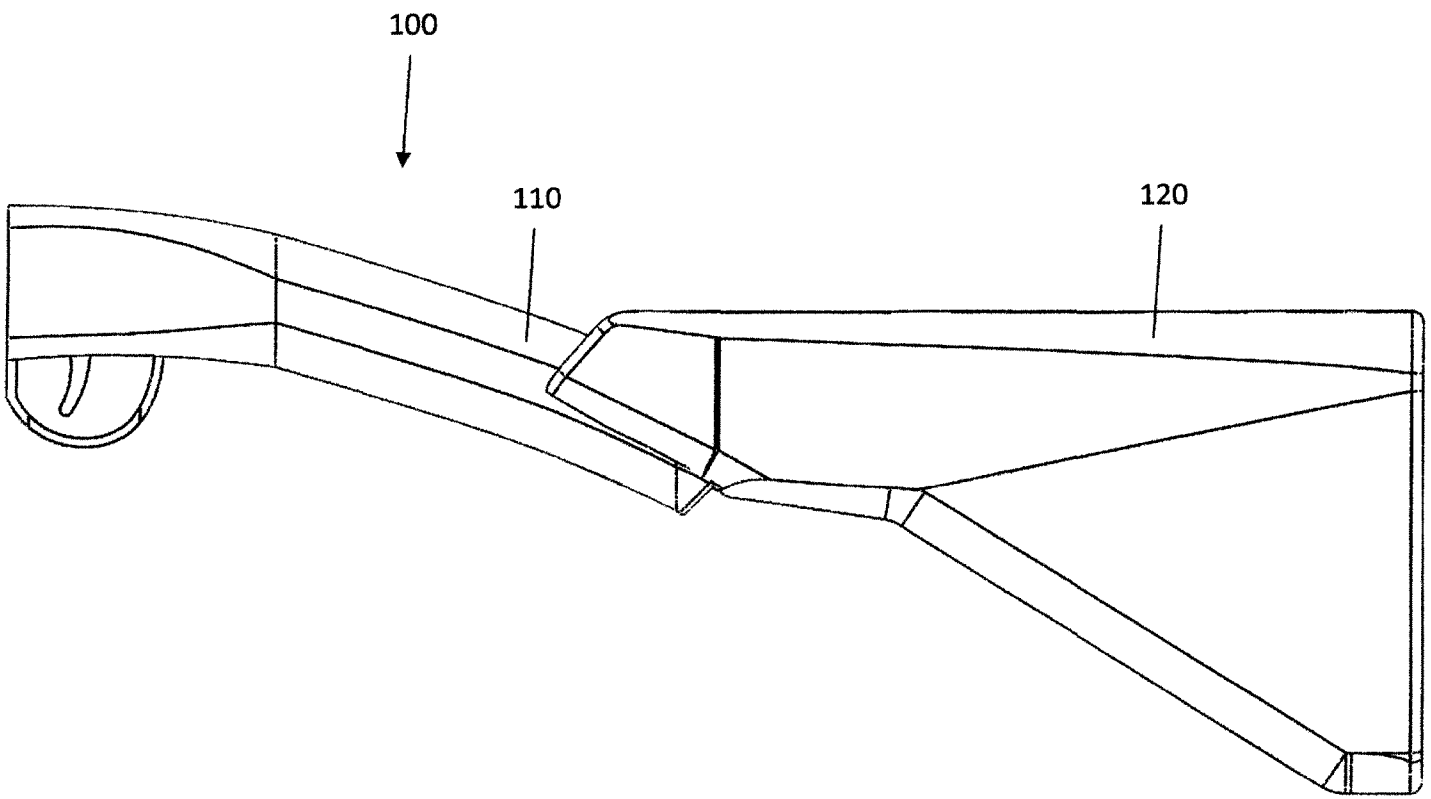
FIG. 1 is a side view of the firearm.
Figure 2:
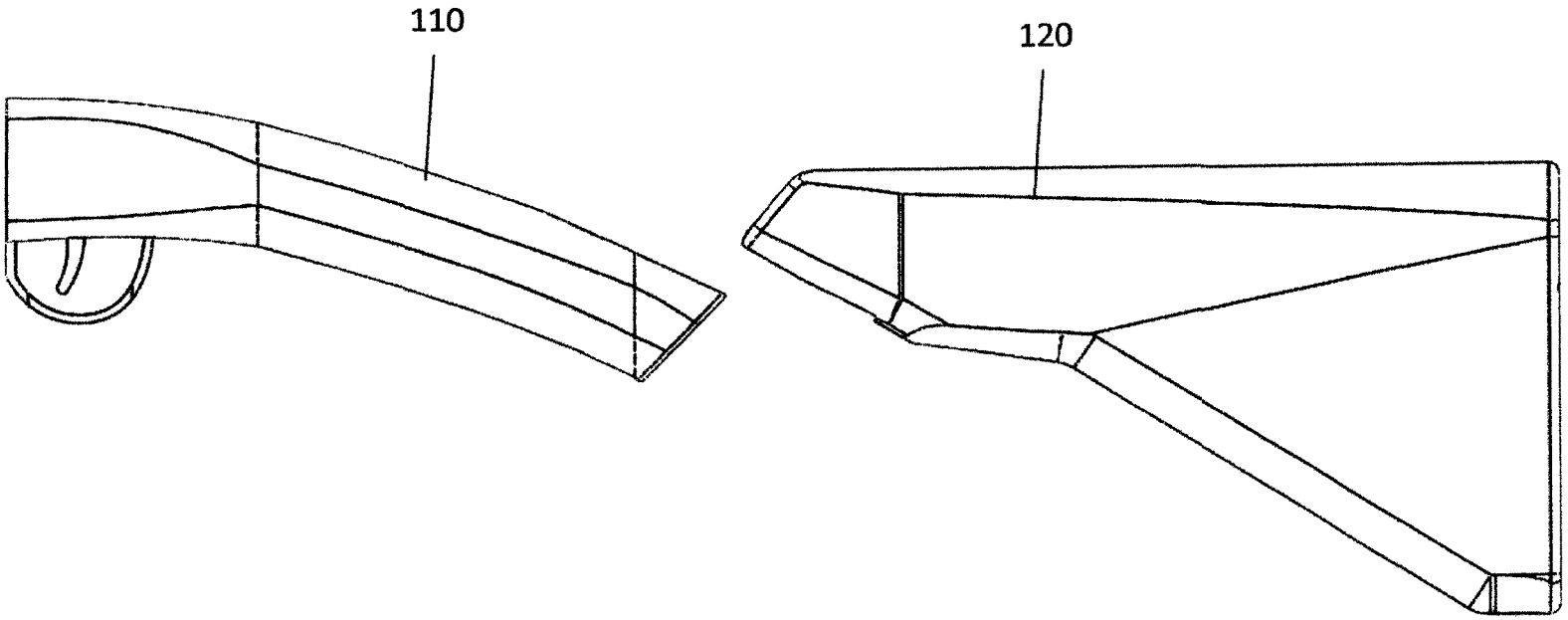
FIG. 2 is a side view of the firearm.
Figure 3:
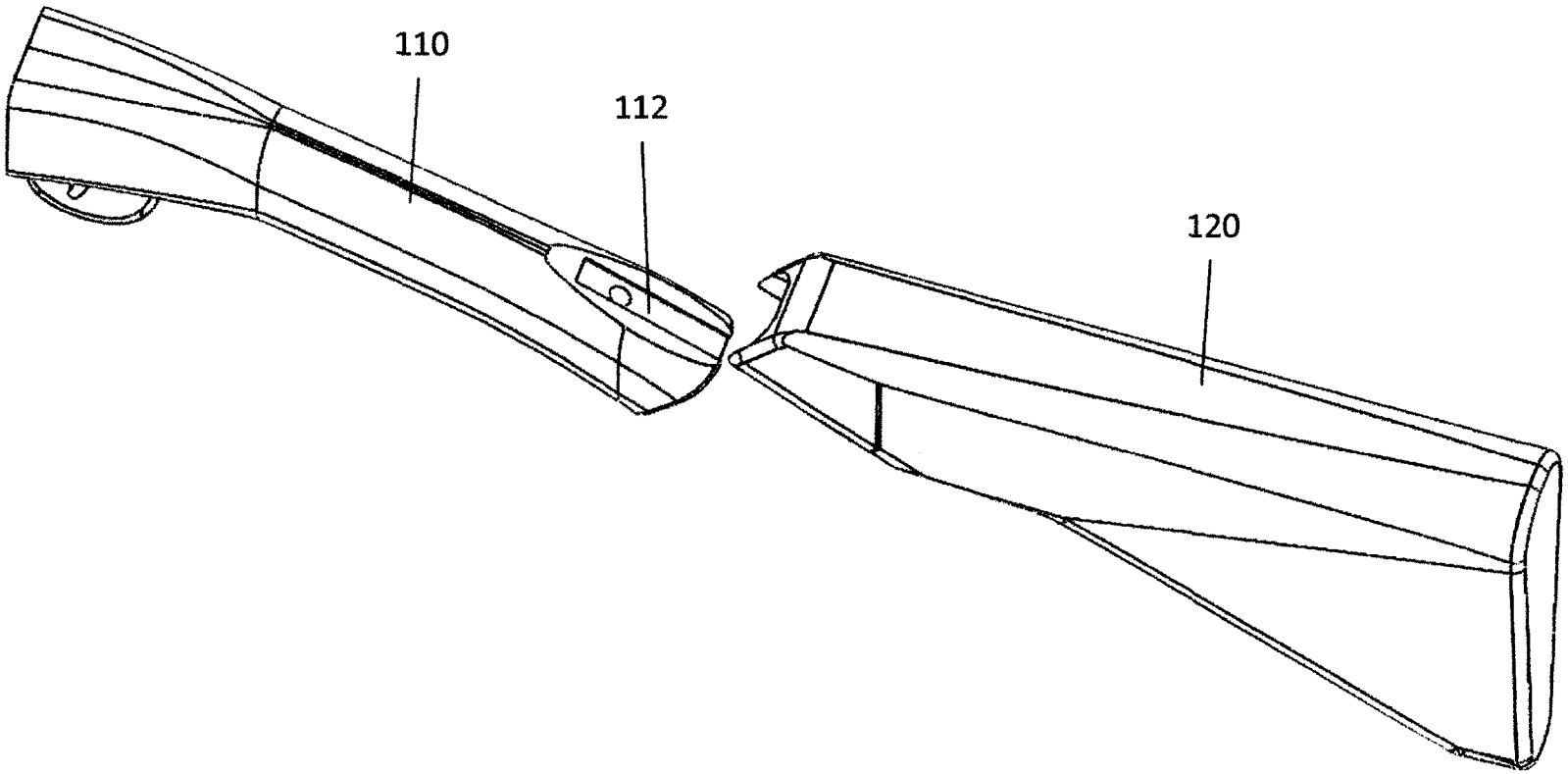
FIG. 3 is a top perspective view of the firearm.
Figure 4:
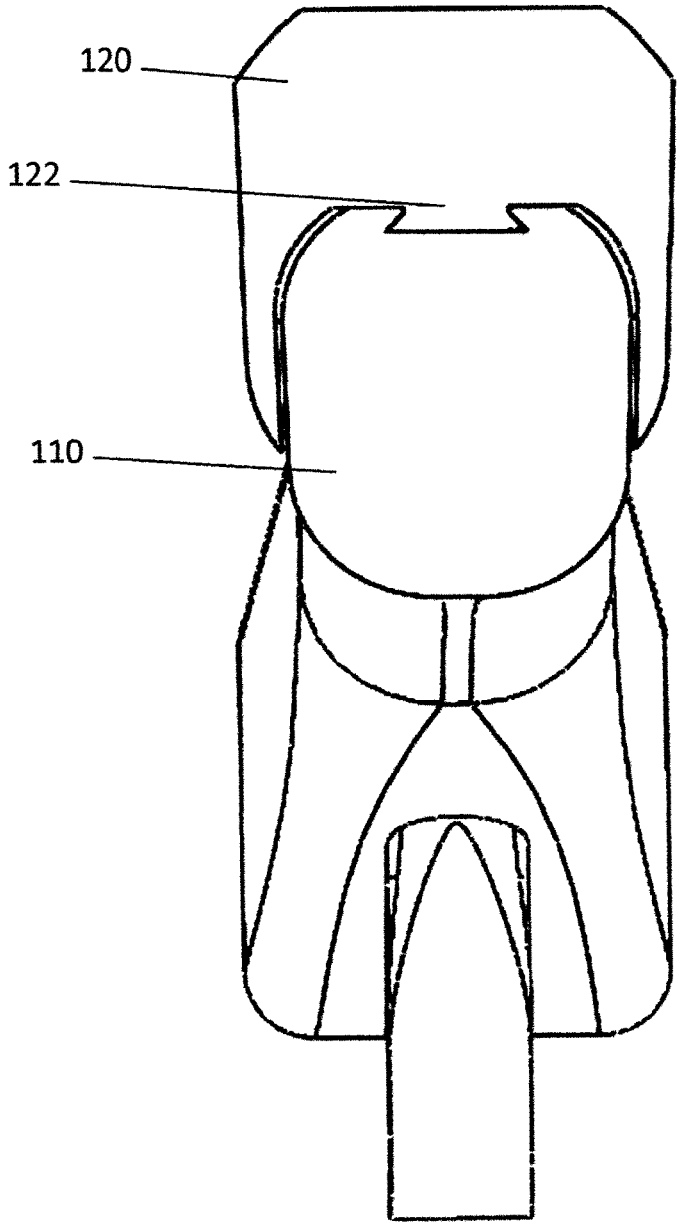
FIG. 4 is a bottom view of the firearm.
Figure 5:
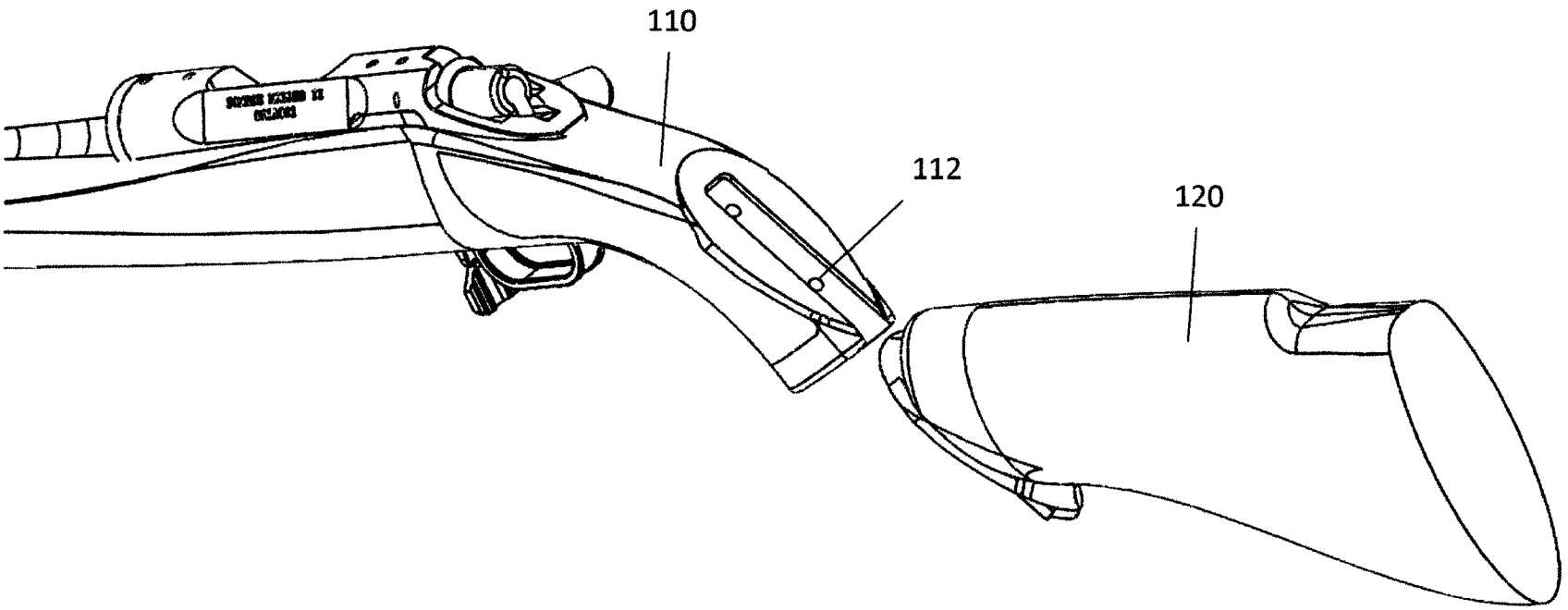
FIG. 5 is a top perspective view of the firearm.
Figure 6:
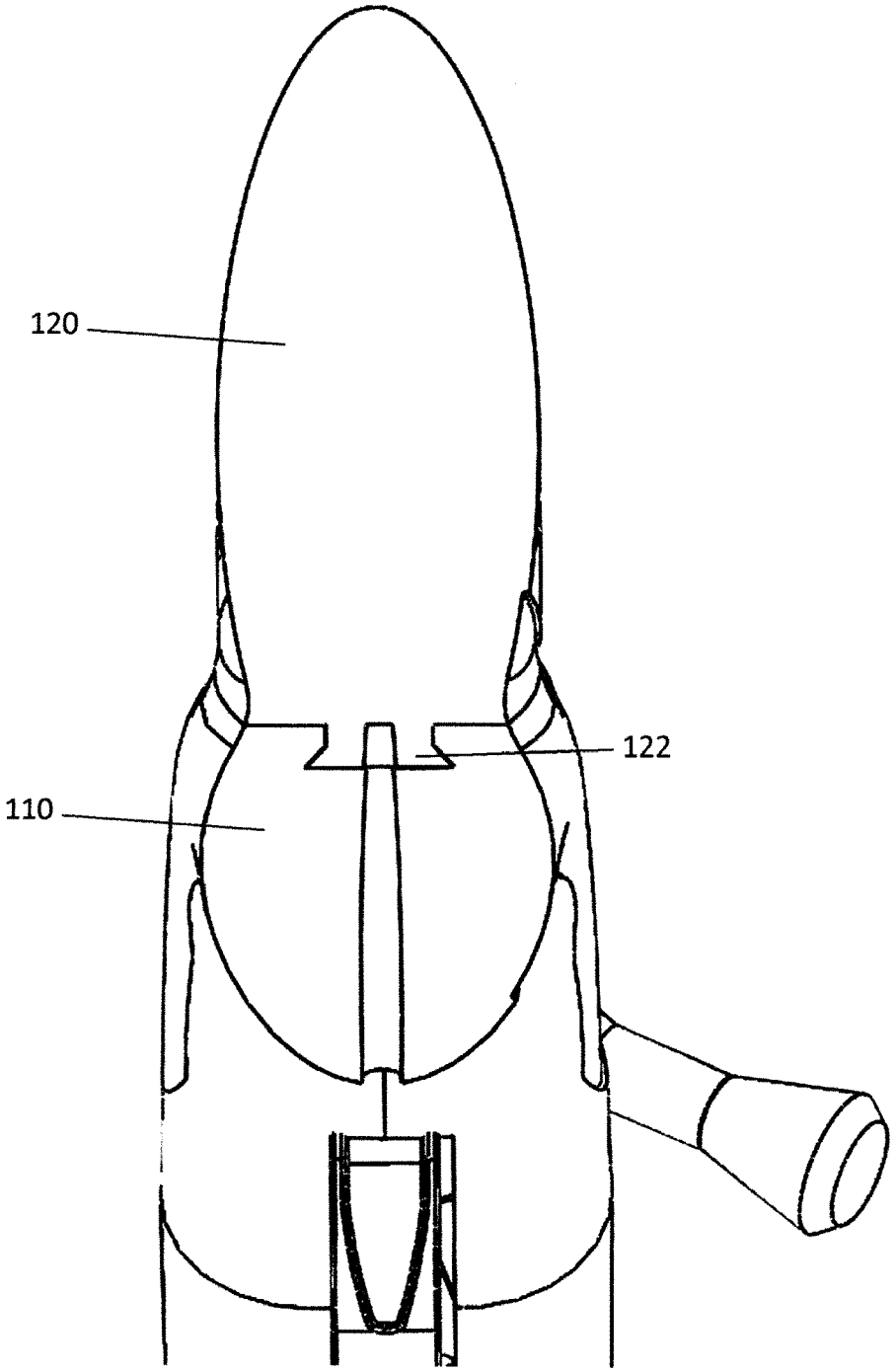
FIG. 6 is a bottom view of the firearm.
Figure 7:
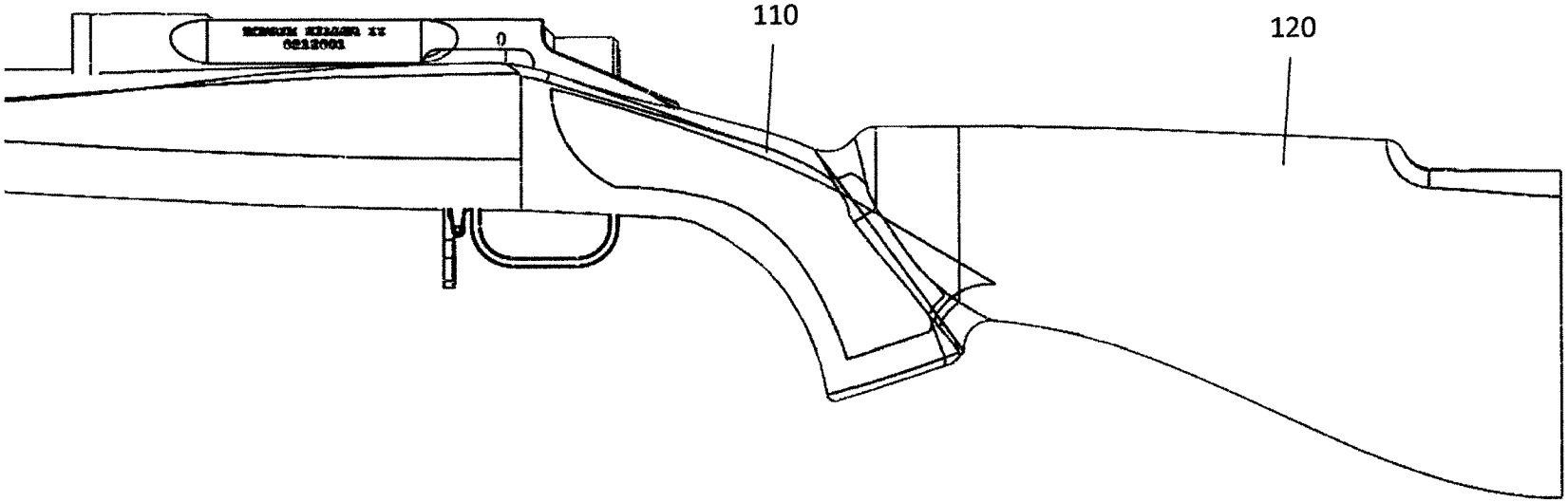
FIG. 7 is a side view of the firearm.
Figure 8:
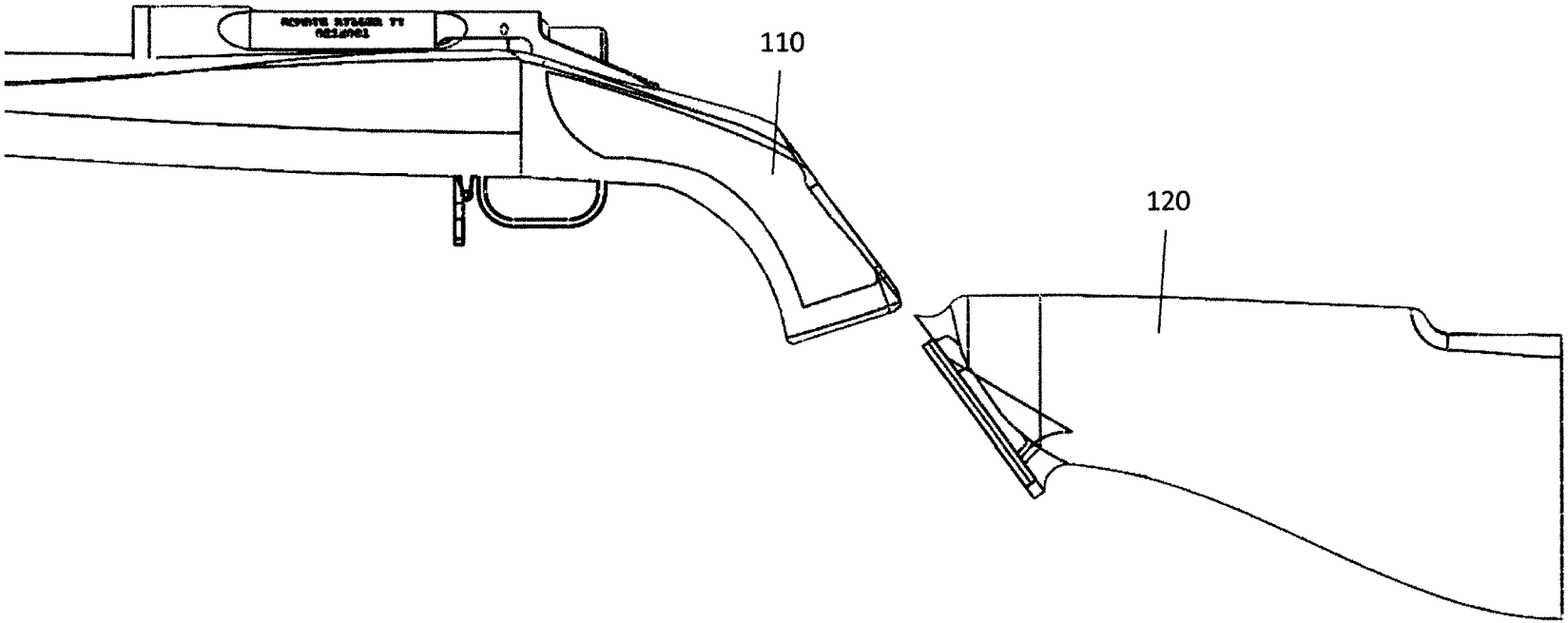
FIG. 8 is a side view of the firearm.
Figure 9:
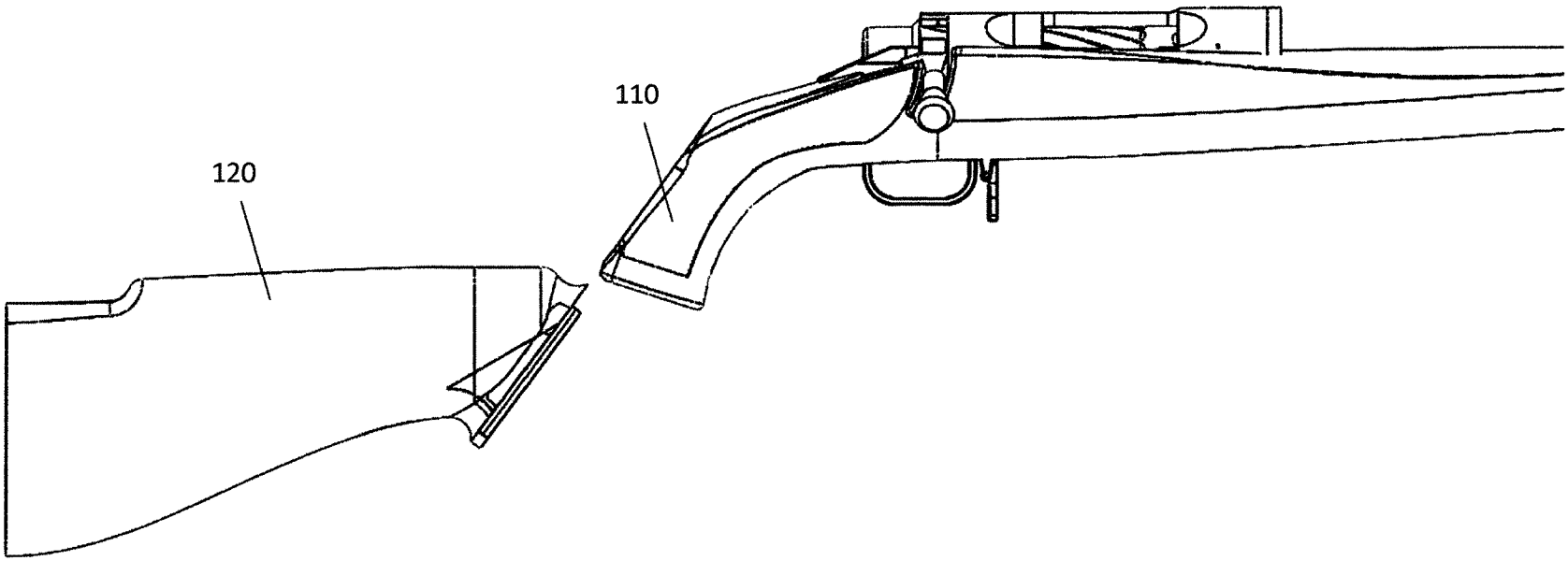
FIG. 9 is a side view of the firearm.
Figure 10:
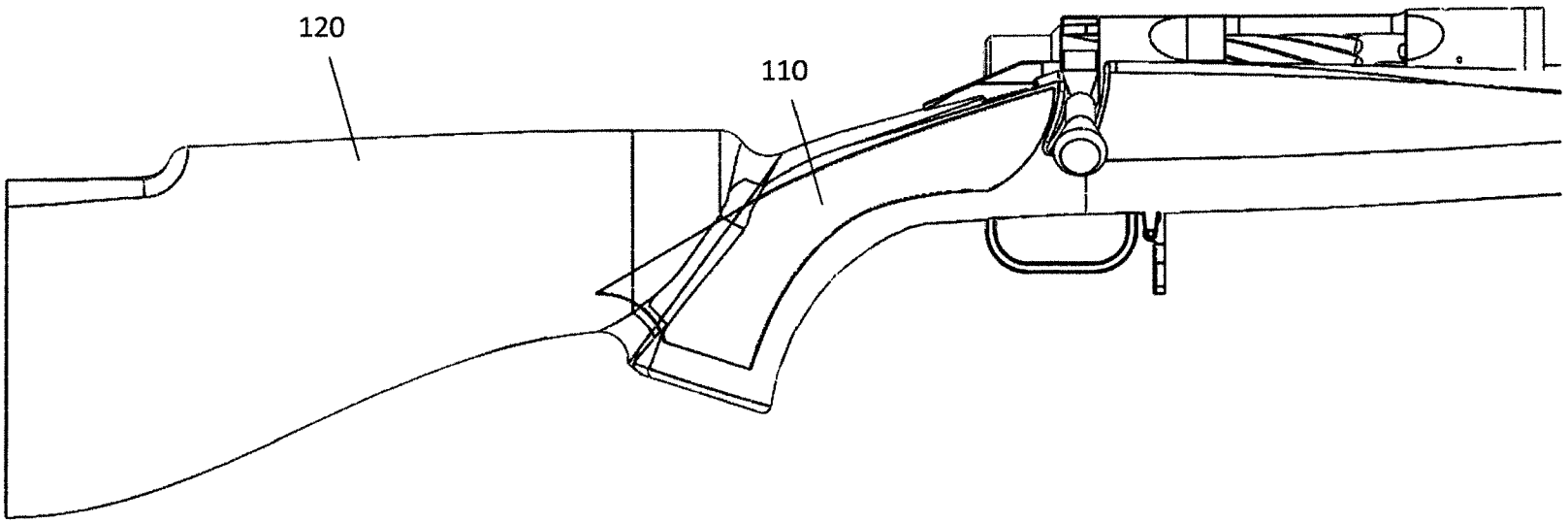
FIG. 10 is a side view of the firearm.
Figure 11:
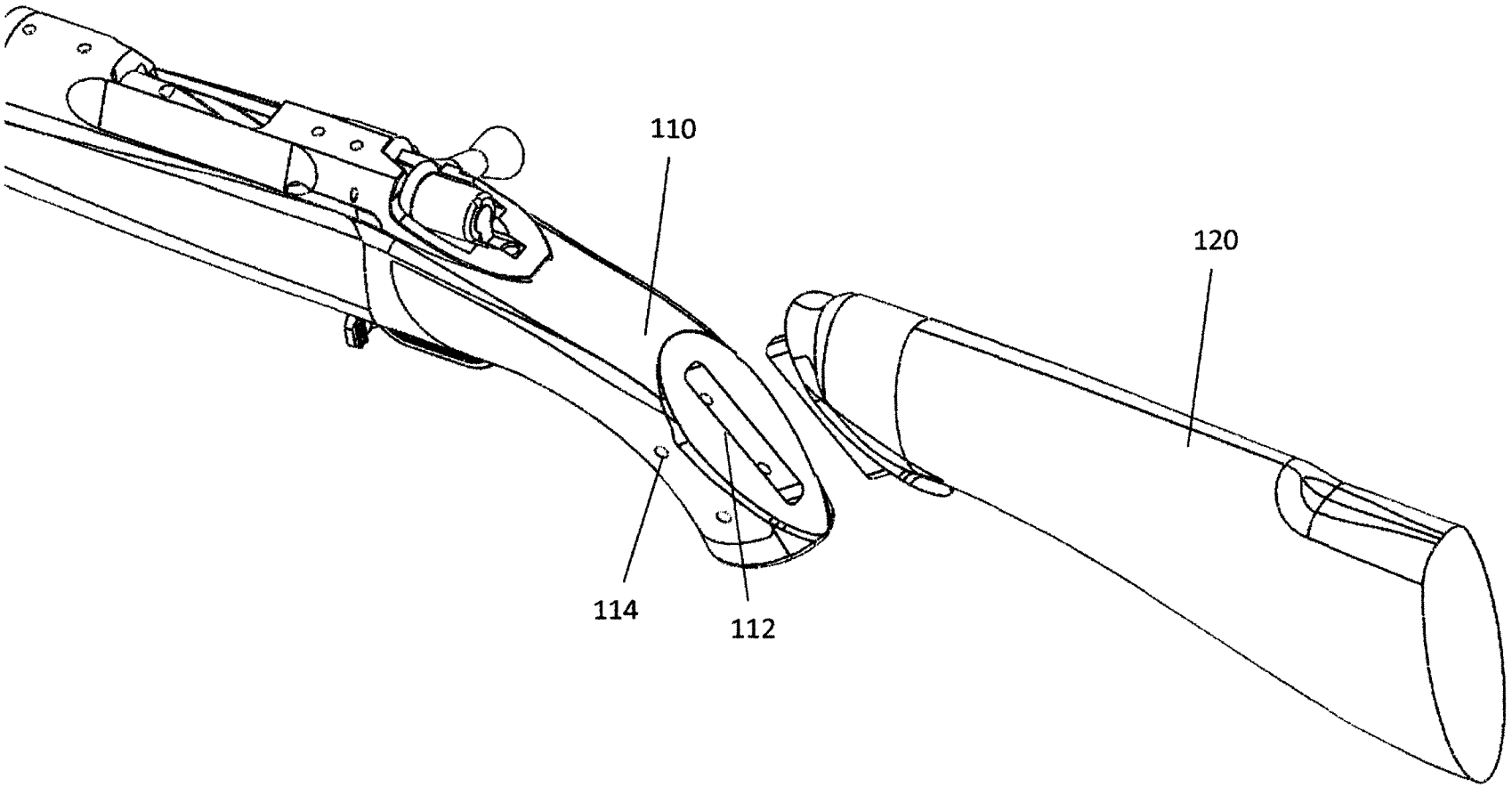
FIG. 11 is a top perspective view of the firearm.
Figure 12:
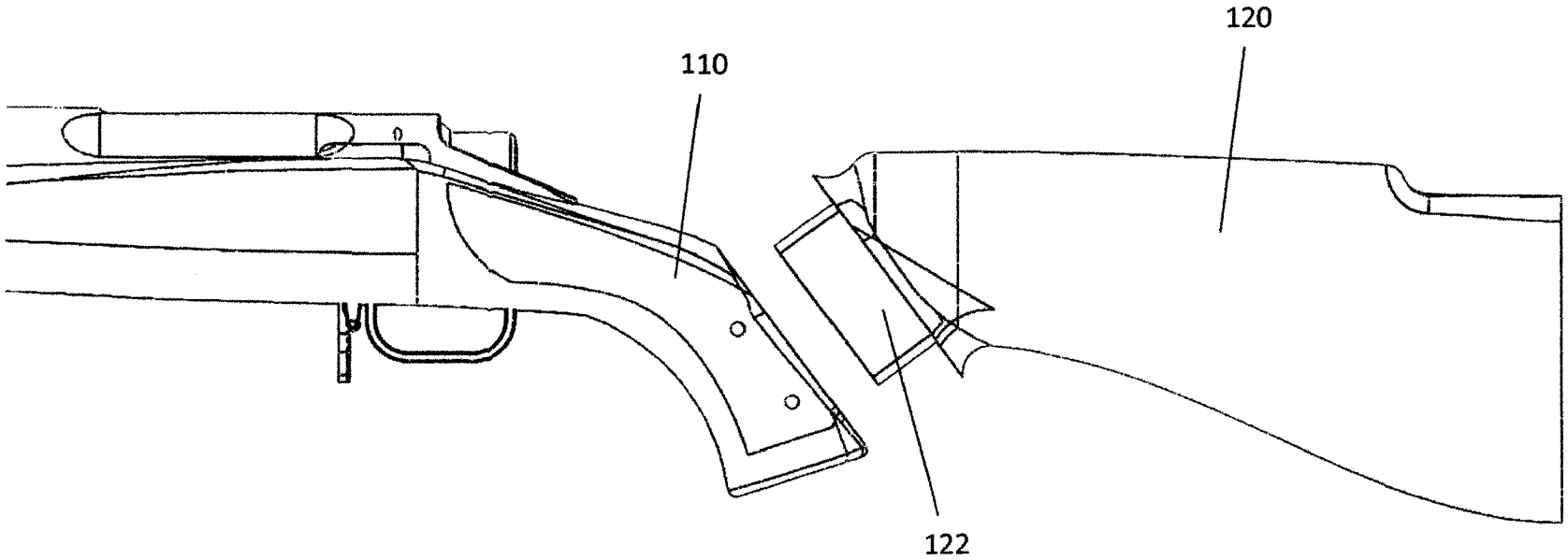
FIG. 12 is a side view of the firearm.
Figure 13:
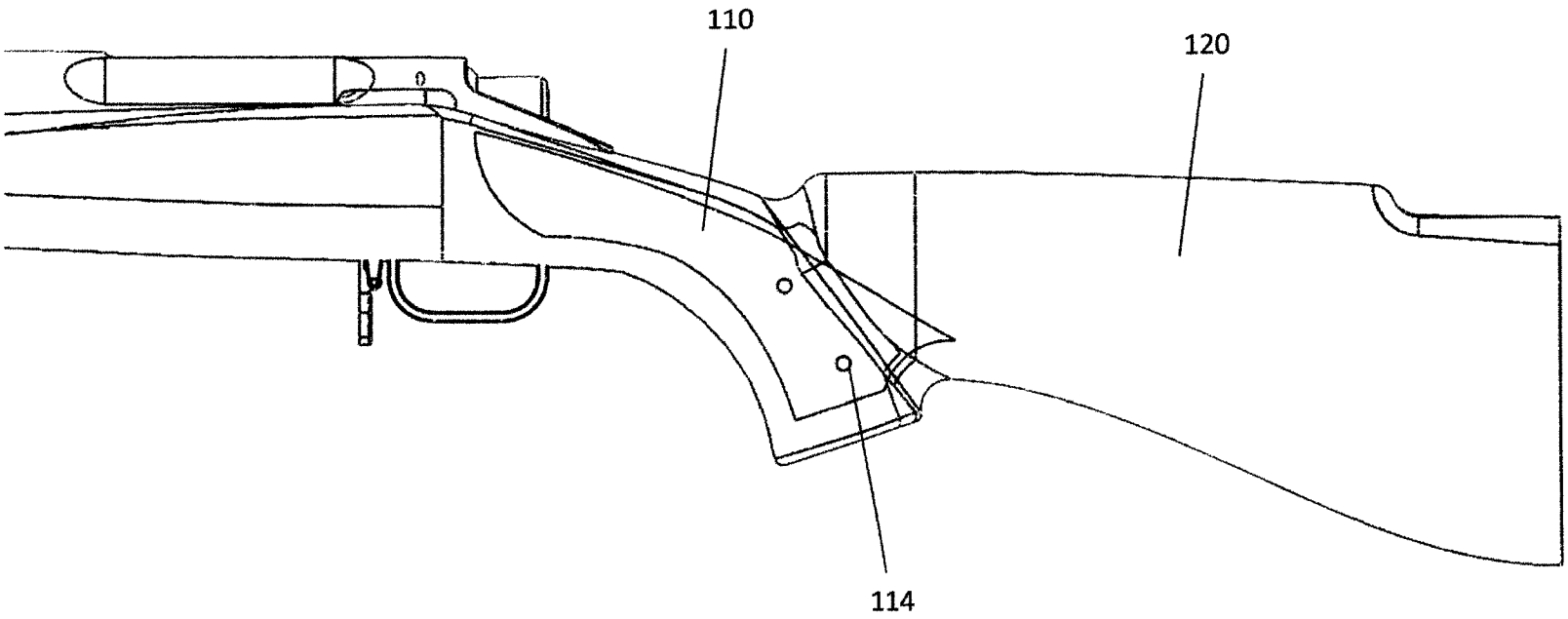
FIG. 13 is a side view of the firearm.
Figure 14:
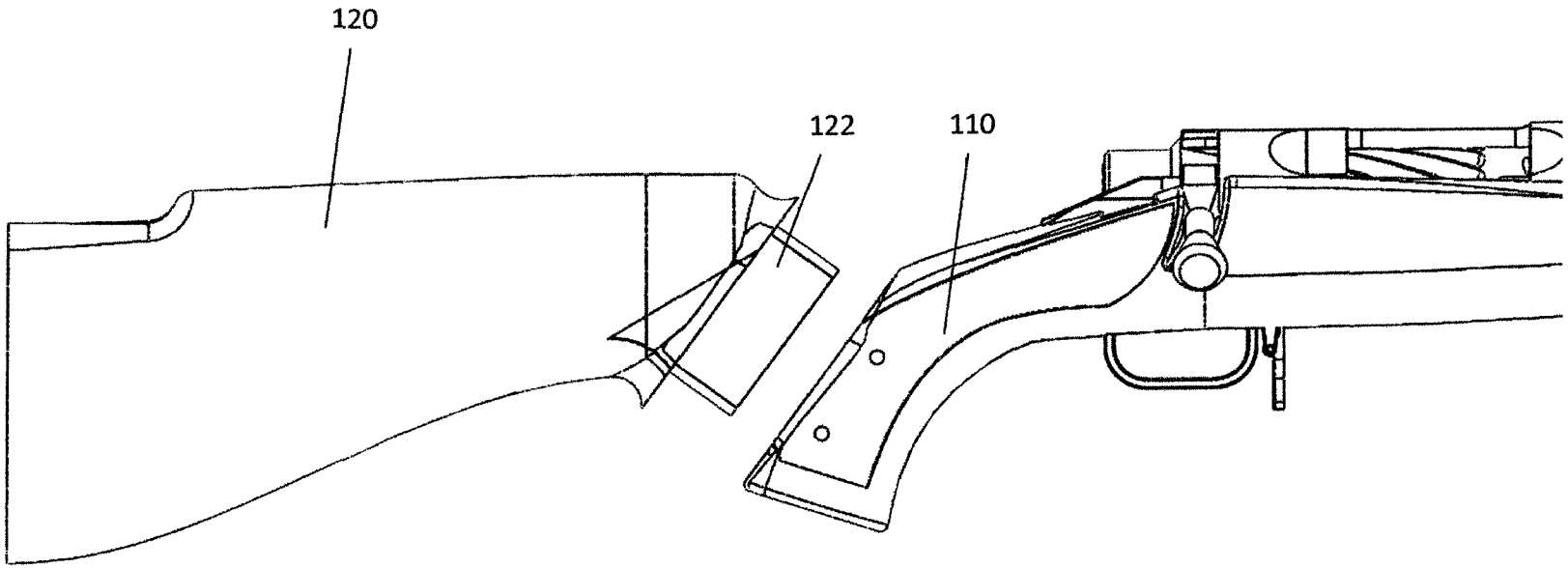
FIG. 14 is a side view of the firearm.
Figure 15:
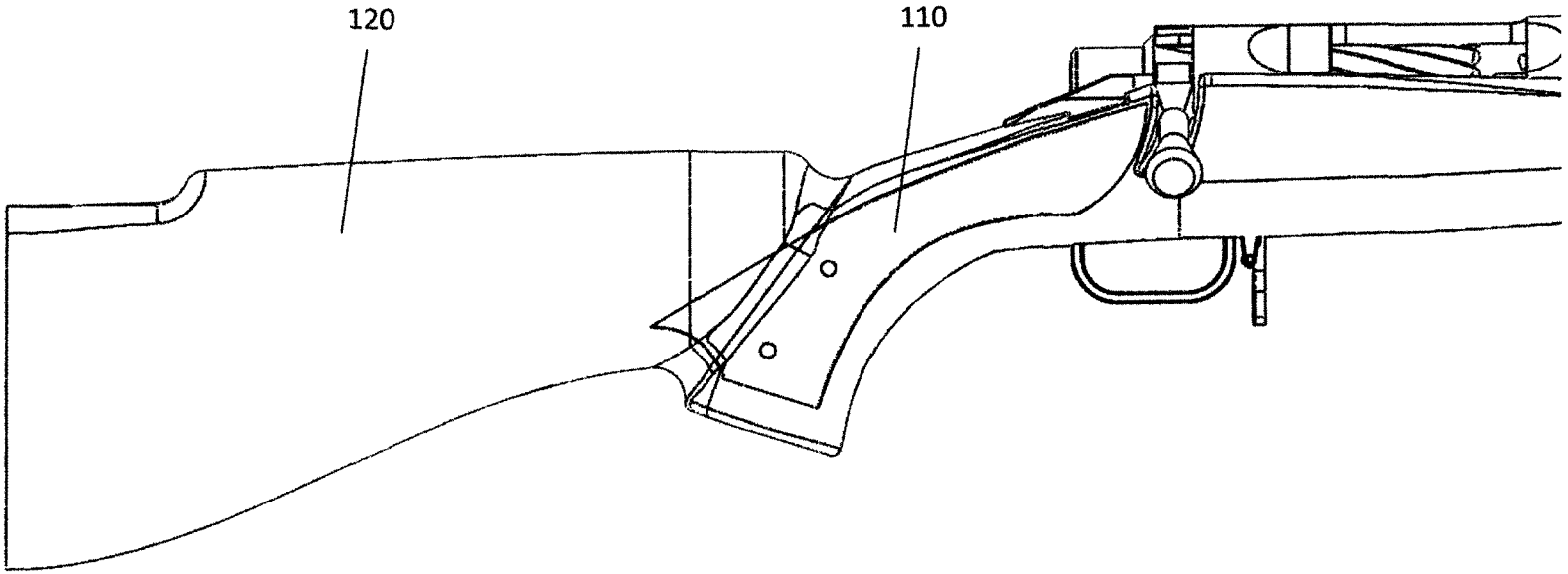
FIG. 15 is a side view of the firearm.

Referring to FIG. 1 through FIG. 4, the preferred embodiment of the invention is illustrated. In this embodiment, the invention pertains to a firearm 100. The firearm 100 may be comprised of an upper receiver and lower receiver. In another embodiment the firearm 100 may be a single bodied firearm without removable components. Attached to the body of the firearm 100 is a grip 110. The grip 110 is preferably permanently attached to the firearm 100. In other embodiments the grip 110 is removably secured to the firearm 100. As illustrated in FIG. 1, the stock 120 is attached to the grip 110. In this version, the user may utilize the firearm 100 as a rifle and hold the end of the stock 120 against the user's shoulder to stabilize and aim the firearm 100. As shown in FIG. 2 and FIG. 3, the user may separate the stock 120 from the grip 110. When the stock 120 is removed from the grip 110, the user may then hold the firearm 100 as a pistol and focus solely on holding the firearm in the user's hand. As illustrated in FIG. 4, the stock 120 has a protrusion 122 which engages the grip 110. In this embodiment the protrusion 122 is a male dovetail. As shown in FIG. 3, the grip 110 has a recess 112 which engages the stock 120. In this embodiment the recess 112 is a female dovetail.

The protrusion 122 may be any size and shape. The recess 112 may be any size and shape. In other embodiments there may be multiple protrusions 122 and multiple recesses 112. The protrusion 122 is shaped such that it is fully encapsulated by the recess 112.

As further illustrated in FIG. 4, the stock 120 extends forward around the grip 110. The stock 120 may extend forward in any amount around the grip 110. The stock 120 may have an aperture so that the grip 110 is fully enclosed in the stock 120.

Referring to FIG. 5 through FIG. 10, an alternative embodiment of the firearm 100 is illustrated. In this embodiment the grip 110 has a recess 112 and the stock 120 has a protrusion 122 which engage each other to removably secure the stock 120 to the grip 110. In this embodiment the stock 120 does not wrap around the grip 110.

Referring to FIG. 11 through FIG. 15, an alternative embodiment of the invention is illustrated. In this embodiment the protrusion 122 of the stock 120 is not dovetail shaped but has a rectangular cross section. In addition the recess 112 of the grip 110 is not a dovetail but has a rectangular cross section to complement the protrusion 122. In this embodiment, the protrusion 122 is inserted directly into the recess 112 rather than slid into the recess 112 as in the preferred embodiment. The protrusion 122 in this embodiment may be held in the recess 112 by any means. As shown in this embodiment the grip 110 has one or more channels 114. The channels 114 may be any size and shape. The channels 114 may extend through the entire body of the grip 110. In some embodiments the protrusion 122 may have apertures which align with the channels 114. A pin may then be placed through the channel and aperture to prevent the stock 120 from being removed from the grip.

Figure 16:
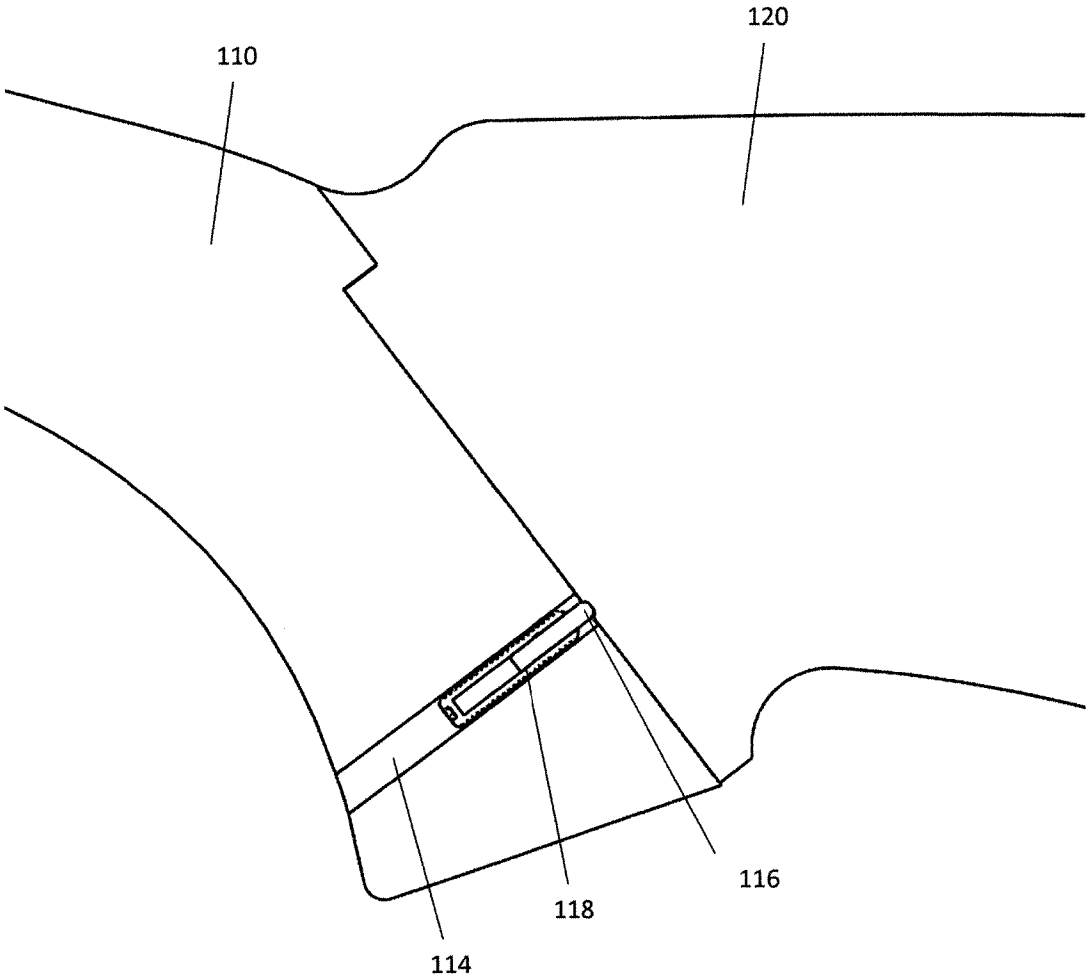
FIG. 16 is a side cut-away view of the firearm.

Referring to FIG. 16, an alternative embodiment of a means to secure the stock 120 to the grip 110 is illustrated. This embodiment is illustrated as being utilized with the dovetail embodiment. However, the means may also be used with the other embodiments as well. As shown, the grip 110 has a channel 114. Placed within the channel is a pin 116. The pin 116 extends slightly out of the channel 114. The end of the pin 114 rests in a depression in the surface of the protrusion 122 to prevent the stock 120 from being removed easily from the grip 110. The pin 116 may be connected to a spring (not shown) which would push the pin 116 outward from the channel and permit the pin 116 to be compressed into the channel 114 to remove the stock 120 from the grip 110. In the embodiment shown the pin 116 is utilized with a set screw 118. The set screw 118 is threaded on the exterior circumference to permit the set screw 118 to be threaded into the channel 114. The set screw 118 may be adjusted in its lateral position in the channel 114 by rotating the set screw 118 inward or outward in the channel 114. The pin 116 is then secured in an interior aperture of the set screw 118.

There may be any number of pins 116 utilized in the invention. In other embodiments there are screws extending through channels 114 which thread into threaded receivers in the protrusion 122. In another embodiment there may be screws inserted through channels 114 on one side of the grip, pass through apertures in the protrusion 122, and thread into threaded channels 114 on the other side of the grip 110. In other embodiments the grip may be secured with a locks or clasps on the exterior of the grip 110 and stock 120.

In any of the embodiments utilized the grip 110 may be any size and shape. In the preferred embodiment the grip is small enough to hold in one hand. In any of the embodiments, the stock 120 is any size and shape. In the preferred embodiment the stock 120 is long enough to extend from the user's had to the user's shoulder for ease of use. The grip 110 and stock 120 may be made from any type of material. In some embodiments there may be multiple stocks 120 of different sizes. One stock 120 may be shaped as a standard shotgun stock and extend to the user's shoulder. In another embodiment another stock 120 may be small and curved so that it completes the roundness of the handle for the user. In this manner the user may hold the grip 110 without experiencing any potential discomfort from needing to cover the recess 112 with a portion of the user's hand.

The invention may be utilized in different means. The invention may be manufactured in place on a firearm 100 or retrofit to a firearm 100. In retrofitting a firearm 100, a user first removes the original handle or stock from the action of the firearm 100. The user then installs the newly designed grip 110 onto the action of the firearm 100. The user may then attach the stock 120 to the grip 110 by placing the protrusion 122 into the recess 112. The user then secures the stock 120 to the grip 110 the pins, bolts, screws, clasps, or other means. When the user desires to use the firearm 100 without the stock, the user removes the pins, bolts, screws, clasps, or whatever means is used to secure the stock 120 to the grip 110. The user then removes the stock 120 from the grip 110 by removing the protrusion 122 from the recess 112.

In other embodiments the user may replace the original grip with the inventive grip 110 in its entirety. In other embodiments the user may use a saw to cut the original grip and attach the inventive grip 110 to the original grip. The inventive grip 110 may be secured to the action of the firearm 100 by means of bolts or screws. If the original grip is cut by the user, the user may attach the inventive grip 110 to the original grip by means of screws, bolts, or glue.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A firearm comprising a) an action;

b) a grip attached to said action, wherein said grip has a recess disposed on a back portion of said grip;

c) a stock removably secured to said grip, wherein said stock has a protrusion disposed on a front portion of said stock, wherein said protrusion is disposed within said recess;

d) one or more pin assemblies comprising a pin and a set screw;

e) wherein said grip further comprises one or more channels disposed in said grip;

f) wherein each of said one or more pin assemblies is respectively disposed in said one or more channels; and g) wherein said set screw has a threaded exterior surface engaging an inner surface of said channel and an inner recess, wherein said pin is disposed in said inner recess of said set screw.

2. The firearm as in claim 1 a) wherein said recess of said grip is shaped as a female dovetail;

b) wherein said protrusion of said stock is shaped as a male dovetail.

3. The firearm as in claim 1 a) wherein said grip has a front portion disposed in a direction of firing of said firearm, a rear portion disposed in a direction opposite a direction of firing said firearm, a top portion disposed near an action of said firearm, and a bottom portion disposed at an end opposite from said action of said firearm;

b) wherein said recess of said grip has a first end and a second end, wherein said first end is disposed at said bottom portion of said grip and said second end is disposed in a top portion of said grip.

4. The firearm as in claim 1 a) wherein said grip has a front portion disposed in a direction of firing of said firearm, a rear portion disposed in a direction opposite a direction of firing said firearm, a top portion disposed near an action of said firearm, and a bottom portion disposed at an end opposite from said action of said firearm;

b) wherein said recess of said grip has a first end and a second end, wherein said first end is disposed at said rear portion of said grip and said second end is disposed in a front portion of said grip.

5. The firearm as in claim 1 wherein said protrusion has one or more indentations for receiving an end of one or more pins.

6. The firearm as in claim 5 a) wherein said grip has a front portion disposed in a direction of firing of said firearm, a rear portion disposed in a direction opposite a direction of firing said firearm, a top portion disposed near an action of said firearm, and a bottom portion disposed at an end opposite from said action of said firearm;

b) wherein said recess of said grip has a first end and a second end, wherein said first end is disposed at said bottom portion of said grip and said second end is disposed in a top portion of said grip.

7. A method for changing the handle of a firearm, wherein said firearm comprises an action, a grip attached to said action, wherein said grip has a recess disposed on a back portion of said grip; and a stock removably secured to said grip, wherein said stock has a protrusion disposed on a front portion of said stock, wherein said protrusion is disposed within said recess; said method comprising a) cutting off a portion of a factory installed handle attached to said action of said firearm;

b) attaching said grip to a remaining portion of said factory installed handle;

c) disengaging said protrusion from said recess;

d) said stock from said grip; and e) firing said firearm by holding said firearm solely by said grip.

8. The method as in claim 7 further comprising a) placing said protrusion of said stock completely within said recess of said grip;

b) ensuring said stock is secured to said grip;

c) placing an end of said stock against a user's shoulder; and d) firing said firearm a second time.

9. The method as in claim 8 further comprising placing one or more bolts through one or more channels disposed in said grip.

* * * * *